US005913660A

United States Patent [19]

Knott

[11] Patent Number: 5,913,660

[45] Date of Patent: Jun. 22, 1999

[54] GAS TURBINE ENGINE FAN BLADE RETENTION

[75] Inventor: David S Knott, Quorn, United Kingdom

[73] Assignee: Rolls-Royce PLC, London, United Kingdom

[21] Appl. No.: 08/886,462

[22] Filed: Jul. 1, 1997

[30] Foreign Application Priority Data

Jul. 27, 1996 [GB] United Kingdom ..... 9615826

[51] Int. Cl.[6] ..... B63H 1/20

[52] U.S. Cl. ..... 416/220 R; 416/219 R

[58] Field of Search ..... 416/219 R, 220 R, 416/221, 248

[56] References Cited

U.S. PATENT DOCUMENTS

| | | | |
|---|---|---|---|
| 2,445,154 | 7/1948 | Reed | 416/221 |
| 2,974,924 | 3/1961 | Rankin et al. | 416/220 R X |
| 3,165,294 | 1/1965 | Anderson | 416/220 |
| 3,986,793 | 10/1976 | Warner et al. | 416/219 R X |
| 4,343,593 | 8/1982 | Harris . | |
| 4,527,952 | 7/1985 | Forestier et al. | 416/220 R |
| 4,995,788 | 2/1991 | Turnberg | 416/248 X |

FOREIGN PATENT DOCUMENTS

| | | | |
|---|---|---|---|
| 976790 | 3/1951 | France | 416/221 |
| 57-210104 | 12/1982 | Japan | 416/220 R |
| 1052008 | 12/1966 | United Kingdom . | |
| 1-523422 | 8/1978 | United Kingdom . | |
| 2030657 | 4/1980 | United Kingdom . | |
| 2083558 | 3/1982 | United Kingdom . | |
| 2115499 | 9/1983 | United Kingdom . | |
| 2243413 | 10/1991 | United Kingdom . | |
| 2-287993 | 10/1995 | United Kingdom . | |

*Primary Examiner*—John E. Ryznic
*Attorney, Agent, or Firm*—Oliff & Berridge, PLC

[57] ABSTRACT

A fan for a gas turbine engine comprises a rotary disc carrying an annular array of radially extending fan blades. Each fan blade has a root portion which is radially constrained within a generally axially extending groove formed within a disc rim. The blade root comprises two portions each radially convergent toward one another with respect to the axis of rotation of the disc. The groove within the disc also comprises two base portions each being correspondingly radially convergent toward one another. Axial retention of the blade root within the groove is achieved by the centrifugal component of the blade load acting in an opposite direction to any applied axial load in the forward or rearward direction.

18 Claims, 4 Drawing Sheets

GAS TURBINE ENGINE FAN BLADE RETENTION

This invention relates to apparatus for retaining blade roots within a corresponding rotor disc. Particularly but not exclusively the invention relates to apparatus for retaining fan blades on a rotor disc of a gas turbine engine such that axial and radial movement of the blades relative to the rotor disc is prevented.

Conventionally gas turbine engines are provided with a front fan which provides thrust and supplies air for the gas generator of the core of the engine. Typically such fans comprise a hub having a plurality of generally axially extending grooves in its periphery which receive the roots of the fan blades. Each fan blade has a root usually of dovetail cross section which locates axially in a correspondingly configured groove provided in the disc rim. Conventionally the base of each dovetail section lies in a plane parallel to the centreline of the engine.

However it is also necessary to ensure each fan blade is prevented from axial movement within the groove. In a gas turbine engine a rotor such as a fan rotor has radially extending fan blades which are located in a plurality of grooves disposed circumferentially around a rotor disc.

Prior proposals for axial retention of fan blades have included the use of retention rings as described in GB1523422 or shear lugs as disclosed in GB2287993. In GB1523422 there is disclosed a fan blade assembly in which the fan blades are axially retained by means of a U shaped bar. The bar locates in appropriate aligned slots in the blade root and hub to provide axial retention. The blade roots and part of the hub rim are partially extended in an upstream direction so as to accommodate the U-shaped bars. A lip, provided on the front face of the hub, co-operates with a ring to maintain the U-shaped bars in position. While such a method of fan blade retention is effective the extension of the hub rim and blade roots in a upstream direction does give rise to undesirable weight penalties. In addition this particular design is unsuitable for retaining blades which are mounted at an incline to the relative rotor axis.

GB2287993 discloses rotatable shear lugs interposed between each fan blade root to provide axial retention in its locked position. However each shear lug needs to accommodate all the axial load on each fan blade to prevent blade movement, thus the lug is necessarily of a certain size and strength to accommodate the axial load.

These prior proposals all require a number of additional parts to axially retain fan blades thus adding to the overall expense and weight of the engine. In addition it is more difficult to balance the fan blades and frettage becomes more of a problem.

It is an object of the present invention to provide a fan blade retention system which attempts to alleviate the problems associated with the aforementioned prior art and to provide improvements generally.

According to the invention there is provided a fan for a gas turbine engine comprising a rotary disc carrying an annular array of radially extending fan blades each fan blade having a root portion which is radially constrained within a generally axially extending groove within said disc rim, characterised in that said root comprises two base portions radially convergent with respect to the axis of rotation of said disc, and that said axially extending groove comprises two base portions each base portion being correspondingly radially convergent.

Advantageously, axial retention of the blade within the groove is achieved by the centrifugal component of the blade load acting in an opposite direction to any applied axial load in the forward or rearward direction.

In one embodiment of the invention said blade root and groove comprise corresponding dovetail cross sections.

In another embodiment the base of the blade is provided with at least one protruding element positioned such that when the blade is located within the groove the protruding element abuts the base of the groove and retains the blade outwards in the dovetail groove.

The present invention will now be described by way of example, with reference to the accompanying drawings in which.

Figure 1:
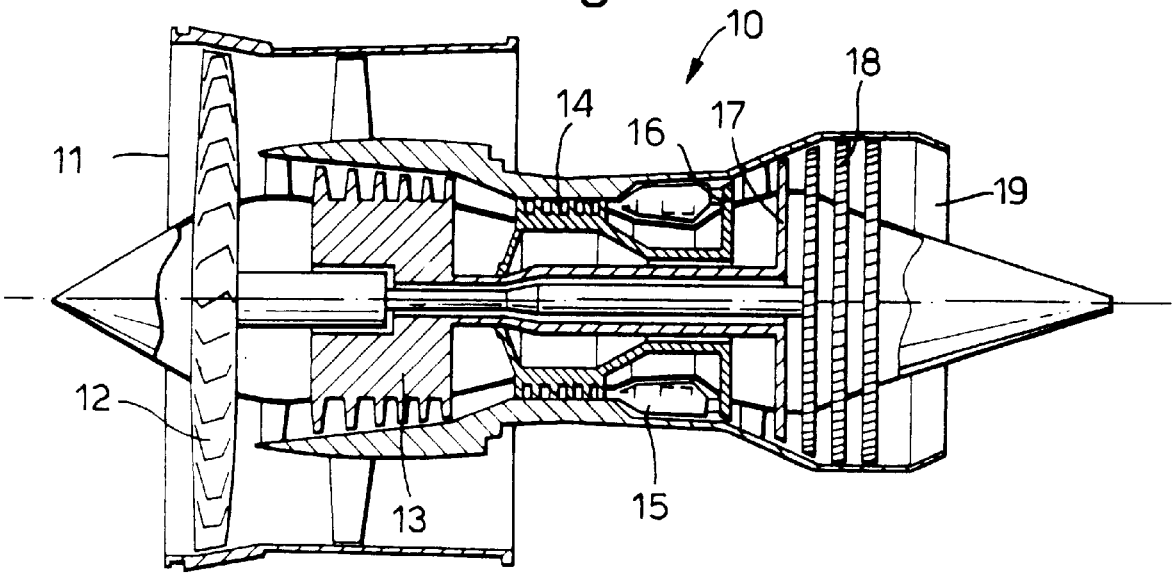
FIG. 1 is a schematic sectioned side view of a ducted fan gas turbine engine having a propulsive fan in accordance with the present invention.
Figure 2:
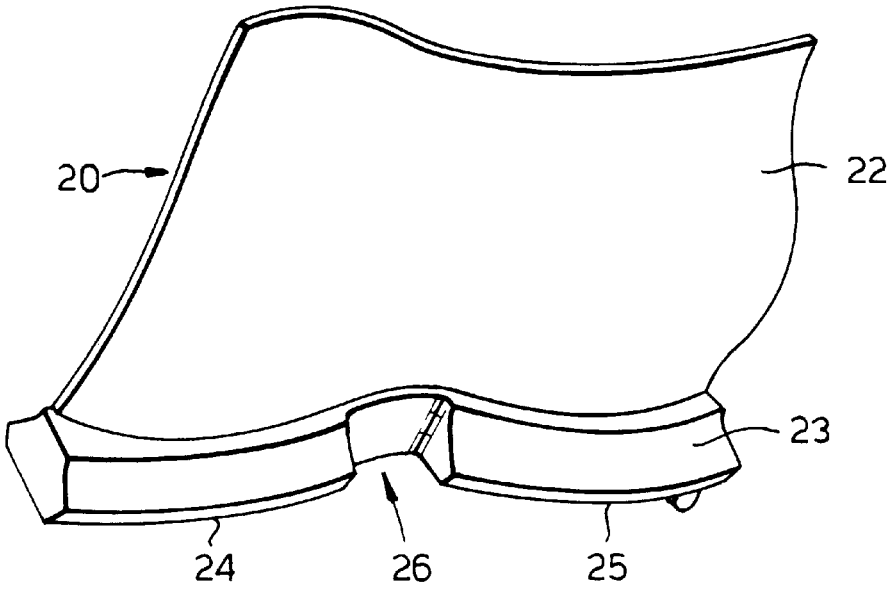
FIG. 2 is a pictorial view of a blade root in accordance with the present invention.

With reference to FIG. 1, a gas turbine engine indicated at 10 is of conventional configuration. It comprises an air inlet 11, ducted fan 12, intermediate and high pressure compressors 13 and 14 respectively, combustion equipment 15, high, intermediate and low pressure turbines 16,17 and 18 respectively and a propulsion nozzle 19. The compressors 13 and 14, the combustion equipment 15 and the turbines 16,17 and 18 together constitute a core engine which drives the fan to provide propulsive thrust.

The fan blade assembly 12 comprises an annular array of radially extending fan blades 20 which are located on a hub 21.

Figure 3:
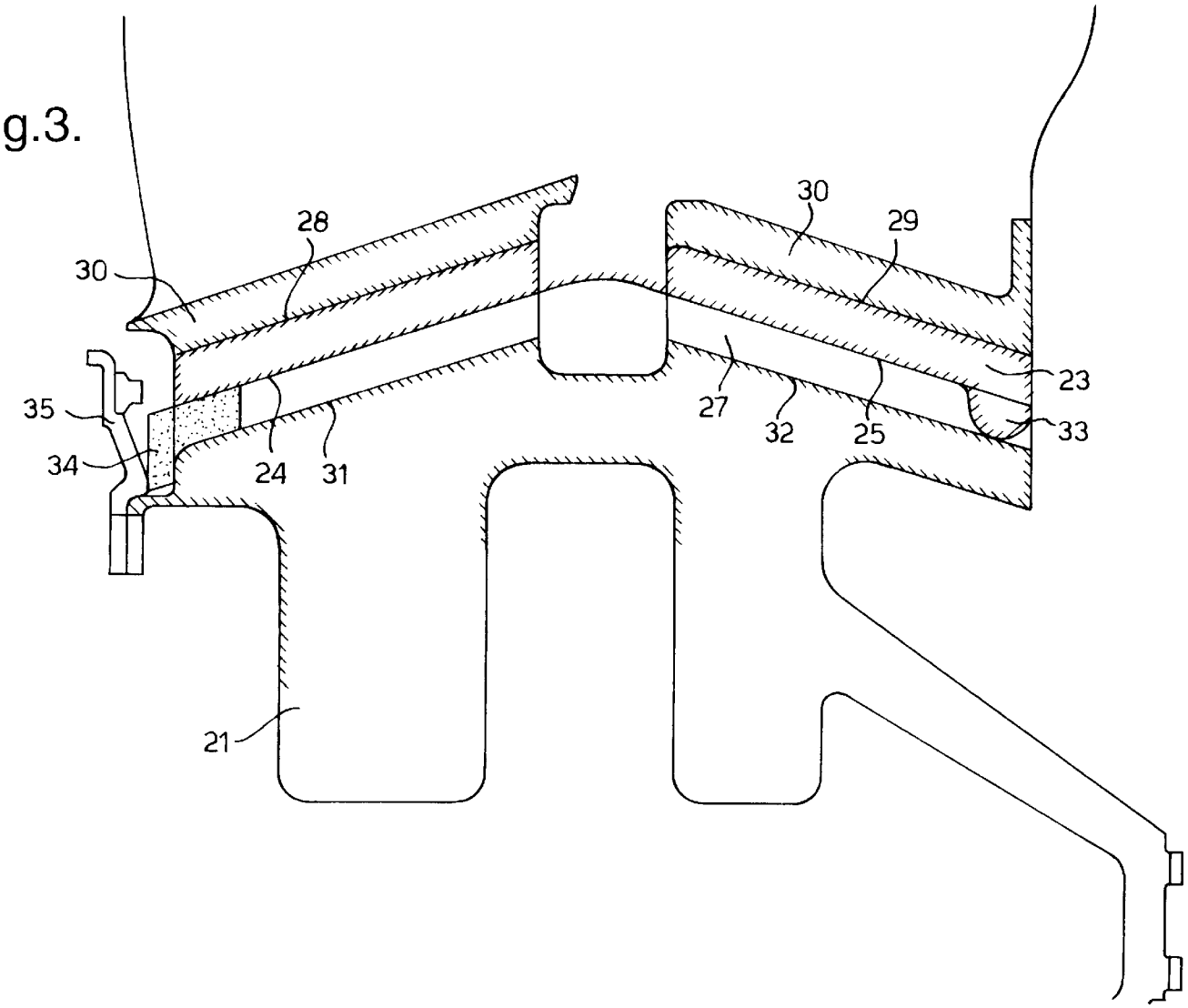
FIG. 3 is a sectioned view through a disc groove showing a blade root positioned therein.

Each fan blade 20 comprises an aerofoil portion 22 and a root portion 23. The root portion 23 is of approximately dovetail cross-sectional configuration. The base of each root portion comprises two sections 24, 25 sloped in opposite directions, as can be seen in FIG. 3. A slot 26 is formed within the base of the root to provide an allowance for the change in shape of slope.

A plurality of generally axially extending grooves 27 of corresponding cross-sectional configuration are provided in the hub 21 to receive the root portions 23. Each sloped section 24, 25 of the blade roots 23 when positioned within the grooves abut each corresponding sloped inner section 28, 29 of the hub rim, 30. The hub also comprises two sloped sections 31, 32.

The base of the dovetail grooves formed within the hub also comprise two correspondingly sloped sections 31, 32 and a slot formed between each sloped section 28, 29. This slot is provided to facilitate the manufacture of each sloped section 28, 29 of the hub (ie. the cutter path for each slope 28, 29 runs into the groove without interfering with the profile of the opposite slope). Each fan blade root 23 and its corresponding disc groove are therefore in the form of an axially extending inverted V. A radial clearance is provided between the base of each root 23 and its corresponding groove to permit assembly and disassembly.

A rounded projecting element 33 is provided at the base of the blade root 23 at one end of sloped section 25 and a removable lug 34 is provided at the end of the other sloped section 24 such that when in position both sloped sections 24, 25 abut the inner corresponding sloped sections 28, 29 of the hub rim 30. The removable lug 34 is retained in place by flange member 35.

Figure 4:
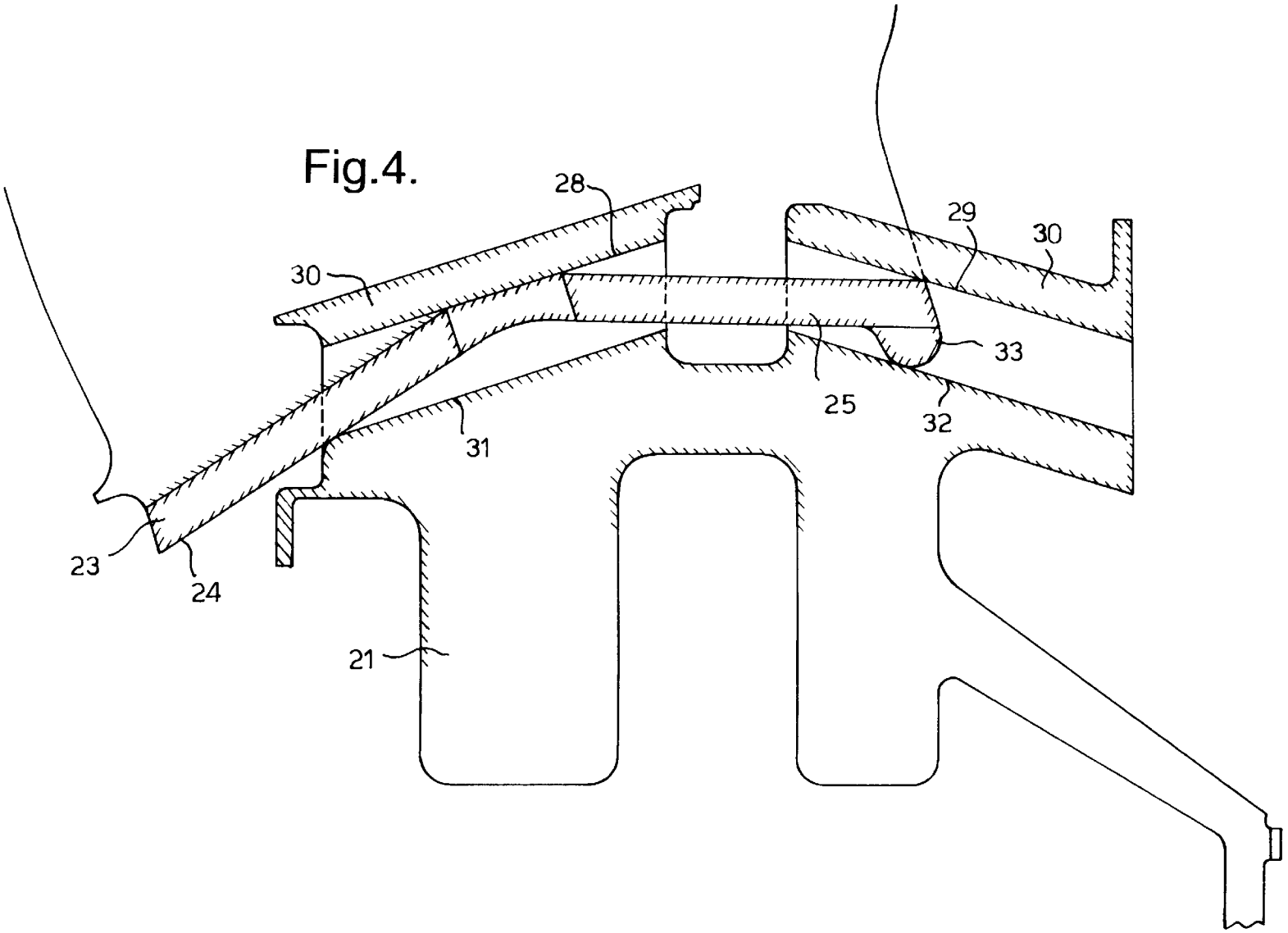
FIG. 4 is a sectioned side view of a blade root in the process of being positioned in the accompanying disc.

Referring to FIGS. 3 and 4, when the fan blade 20 is in position within the groove 27 a clearance is provided between the base of the root blade root 23 and the base of the groove 27. This ensures that the blade can be inserted and removed with ease by removing lug 34 and flange member 35 and rotating the blade axially and outward from said groove.

Once in position the blade is retained against the disc rim 30 by lug 34 and rounded projecting element 33. During rotation of the hub, since the blade 20 is mounted at a 'double' incline the centrifugal force acting on the blade 20 translates into both a radial and axial force (with respect to the rotation of the disc). The blade 20 is secured against the radial force by a dovetail root 23. Axial retention of the blade 20 is provided by the axial centrifugal component of the blade load acting in the opposite direction to any applied forward or rearward axial load. If the axial load in either direction increases to such a level that all the blade load is transferred to the front or rear rim 28, 29, movement down or along that rim is prevented by lug 34 or rounded projecting element 33.

This arrangement has the advantage that weight is minimized due to material efficient design of the root. Frettage is reduced by the force/load counteraction provided by the counterslope arrangement. Also the number of parts required for blade retention is reduced since the requirement for a shear key or shear ring is dispensed with.

Figure 5:
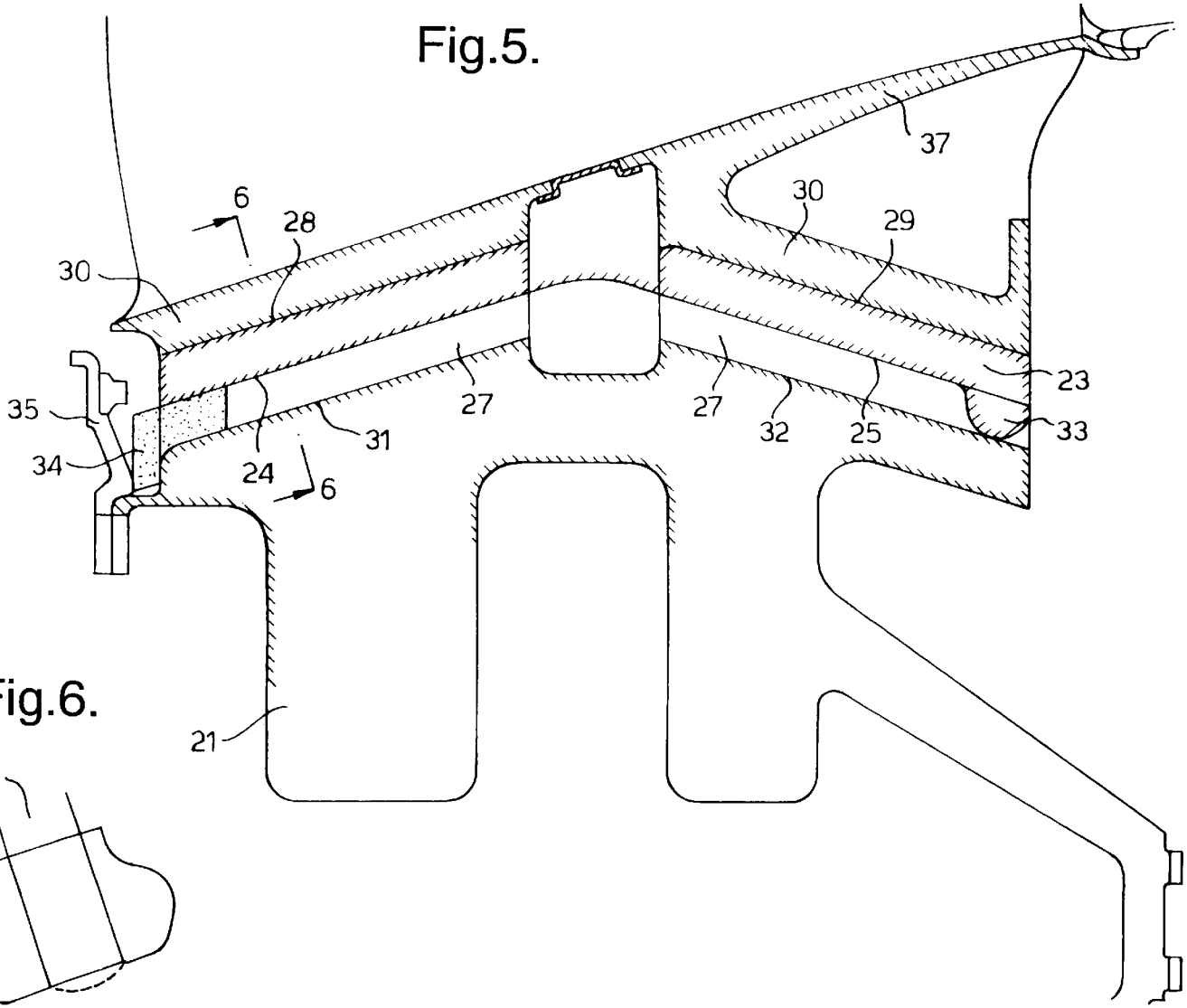
FIG. 5 is a sectioned side view of a blade root positioned within a disc groove including an integral seal.
Figure 6:
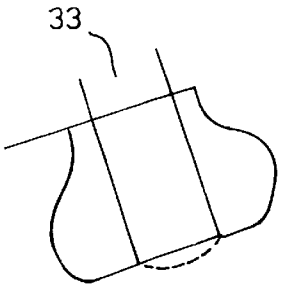
FIG. 6 is a view of a section B—B through FIG. 5 showing the dovetail shape of the disc groove.

In the embodiment illustrated in FIG. 5 an integral seal 37 is provided to seal the blade and an adjacent wall member. (not shown). This embodiment is relevant to an arrangement where adjacent fan blades do not have platforms, the space therebetween being bridged by wall members and associated seals.

I claim:

1. A fan for a gas turbine engine, comprising:

a rotary hub rotatable about an axis of rotation and having a hub rim extending about a periphery of the rotary hub, the hub rim defining an annular array of V-shaped grooves, each V-shaped groove extending generally axially and diverging towards the axis of rotation; and an annular array of radially extending fan blades releasably connected to the rotary hub, each fan blade having an aerofoil portion and a V-shaped root portion connected to each other, the V-shaped root portion extending generally axially and diverging away from the aerofoil portion, the V-shaped root portion sized to be received by and retained in registration with the V-shaped groove.

2. A fan according to claim 1, wherein at least one of the V-shaped groove and the V-shaped root portion has a dovetailed cross-sectional configuration.

3. A fan according to claim 1, wherein the V-shaped groove and the V-shaped root portion are curved.

4. A fan according to claim 1, wherein the V-shaped root portion includes a projecting element for causing the V-shaped root portion to abut the hub rim when the V-shaped root portion is received by the V-shaped groove.

5. A fan according to claim 4 wherein the projecting element is formed integrally with the V-shaped root portion.

6. A fan according to claim 1, further comprising a retainer member sized for at least partial insertion into the V-shaped groove for causing the V-shaped root portion to abut the hub rim and to axially retain the V-shaped root portion in the V-shaped groove when the V-shaped root portion is received by the V-shaped groove.

7. A fan according to claim 6, wherein the retainer member includes a L-shaped lug and a flange member for retaining the L-shaped lug in place.

8. A fan for a gas turbine engine, comprising:

a rotary hub rotatable about an axis of rotation and having a hub rim extending about a periphery of the rotary hub, the hub rim defining an annular array of V-shaped grooves, each V-shaped groove having a generally dovetailed cross-sectional configuration, extending generally axially and diverging toward the axis of rotation; and an annular array of radially extending fan blades releasably connected to the rotary hub, each fan blade having an aerofoil portion and a V-shaped root portion connected to each other, the V-shaped root portion having a generally dovetailed cross-sectional configuration, extending generally axially and diverging away from the aerofoil portion, the V-shaped root portion including a projecting element, the V-shaped root portion sized to be received by and retained in registration with the V-shaped groove wherein the projecting element causes the V-shaped root portion to abut the hub rim when the V-shaped root portion is received by the V-shaped groove.

9. A fan for a gas turbine engine, comprising:

a rotary hub rotatable about an axis of rotation and having a hub rim extending about a periphery of the rotary hub, the hub rim defining an annular array of V-shaped grooves, each V-shaped groove having a generally dovetailed cross-sectional configuration, extending generally axially and diverging toward the axis of rotation;

an annular array of radially extending fan blades releasably connected to the rotary hub, each fan blade having an aerofoil portion and a V-shaped root portion connected to each other, the V-shaped root portion extending generally axially and diverging away from the aerofoil portion, the V-shaped root portion sized to be received by and retained in the V-shaped groove; and a retainer member sized for at least partial insertion into the V-shaped groove for causing the V-shaped root portion to abut the hub rim and axially retaining the V-shaped root portion in registration with the V-shaped groove.

10. A fan according to claim 9, wherein the retainer member includes a L-shaped lug and a flange member for retaining the L-shaped lug in place.

11. A fan for a gas turbine engine, comprising:

a rotary hub carrying an annular array of radially extending fan blades, the rotary hub having an axis of rotation and a hub rim, the hub rim having an annular array of generally axially extending V-shaped grooves, each fan blade having a V-shaped root portion which is radially constrained within a corresponding one of the axially extending grooves, each V-shaped root portion and each V-shaped groove having a dovetailed cross-sectional configuration.

12. A fan as claimed in claim 11 wherein said root portion and its corresponding disc groove define an axially extending inverted V shape.

13. A fan as claimed in claim 11 wherein said dovetail groove base is curved in the axial direction with respect to the axis of rotation of the disc.

14. A fan as claimed in claim 11 further comprising at least one protruding element positioned at a base of said blade such that when the blade is located in the disc groove the protruding element abuts the base of the groove such that the blade is spaced apart from the base of the groove.

15. A fan according to claim 14 wherein said protruding element comprises a lug radially extending with respect to the axis of rotation of said disc.

16. A fan according to claim 14 said retaining element comprises an L shaped wedge positioned between the base of the blade root and the base of the groove such that the blade root abuts the inner portion of the disc rim.

17. A fan according to claims 11 further comprising a removable retaining element provided to locate the blade root within said groove.

18. A fan according to claim 10 further comprising a slot axially extending, with respect to the axis of rotation of the disc and formed between opposite ends of each V-shaped root portion.

* * * * *